US005865710A

United States Patent [19]

Wilson-Hyde

[11] Patent Number: 5,865,710

[45] Date of Patent: Feb. 2, 1999

[54] STEP AEROBIC PLATFORM

[76] Inventor: Cynthia Wilson-Hyde, 4931 SW. 95 Ave., Miami, Fla. 33165

[21] Appl. No.: 690,767

[22] Filed: Aug. 1, 1996

[51] Int. Cl.[6] ..... A63B 22/00

[52] U.S. Cl. ..... 482/52; 482/51; 297/217.7; 297/214

[58] Field of Search ..... 297/14, 60, 40, 297/217.7, 344.18; 108/133, 130; 482/51, 52

[56] References Cited

U.S. PATENT DOCUMENTS

| | | | |
|---|---|---|---|
| 107,455 | 9/1870 | Coolige et al. | 297/60 |
| D. 157,436 | 2/1950 | Rogers | D6/350 |
| D. 331,808 | 12/1992 | Paul et al. | D6/350 |
| 1,630,102 | 5/1927 | Zimmerman | 108/133 |
| 2,147,972 | 2/1939 | Edwards | 108/133 |
| 2,670,029 | 2/1954 | Rossi | 4/578.1 |
| 2,701,745 | 2/1955 | Mackintosh | 108/133 |
| 2,813,276 | 11/1957 | Lanza | 4/579 |
| 2,829,705 | 11/1954 | Godshalk et al. . | |
| 3,262,134 | 7/1966 | Bramble, Jr. | 482/53 |
| 3,319,273 | 5/1967 | Solin | 482/23 |
| 3,394,963 | 7/1968 | Antonioli | 297/217.7 |
| 3,433,477 | 3/1969 | Roberts | 482/23 |
| 3,628,791 | 12/1971 | Garcia | 272/83 R |
| 4,289,308 | 9/1981 | Allen et al. | 272/70 |
| 4,549,732 | 10/1985 | Hoffman | 272/70 |
| 4,639,037 | 1/1987 | Maruyama | 248/240.4 |
| 4,705,028 | 11/1987 | Melby | 128/258 |
| 4,743,008 | 5/1988 | Fermaglich | 272/69 |
| 4,984,785 | 1/1991 | Wilkinson | 272/70 |
| 4,986,532 | 1/1991 | DeCloux | 272/70 |
| 5,137,240 | 8/1992 | Van Meter | 248/240.4 |
| 5,185,892 | 2/1993 | Mitchell | 297/14 |
| 5,277,684 | 1/1994 | Harris | 482/130 |
| 5,421,273 | 6/1995 | Lin | 108/180 |
| 5,454,771 | 10/1995 | Wilson-Hyde | 482/52 |
| 5,533,950 | 7/1996 | Lochbaum | 482/51 |
| 5,547,205 | 8/1996 | do Rosario Sousa de Cabedo | 297/60 |

FOREIGN PATENT DOCUMENTS

| | | | |
|---|---|---|---|
| 77529 | 4/1954 | Germany | 4/579 |
| 471366 | 3/1952 | Italy | 297/331 |

*Primary Examiner*—Jerome W. Donnelly
*Attorney, Agent, or Firm*—Young & Basile, P.C.

[57] ABSTRACT

An improved step aerobic platform comprises a single handrail having an integral foldable seat that locks in an upright position when in use, and can be retracted and folded between legs of the handrail when not in use.

7 Claims, 2 Drawing Sheets

STEP AEROBIC PLATFORM

FIELD OF THE INVENTION

This invention relates to an improved step aerobic platform having a support structure with a retractable seat.

BACKGROUND OF THE INVENTION

Step aerobics, wherein a person steps on and off a slightly elevated platform, has become an important form of exercise in recent years. Step aerobics provides a cardiovascular workout with minimal investment of equipment such that a wide spectrum of persons can enjoy this form of exercise. Although many people own and use a step aerobic platform, current exercise equipment that consist strictly of a raised platform is inadequate to be used by the elderly or physically challenged individuals. The current commercially available step aerobic platforms offer no support or balance system to minimize the chance of an individual falling.

SUMMARY OF THE INVENTION

The current invention provides an improved step aerobic platform having a single handrail and an integral seat that may be positioned up or down. The handrail assists the elderly and the physically challenged individual to step onto and off the step aerobic platform and to maintain balance while on the platform. The integral seat provides further support during sitting portions of the exercise. The seat comprises a foldable portion that can be stored between the legs of the handrail and lowered to form the seat having the handrail as a back rest. Hinging means attached to portions of the seat and the handrails provide a locking mechanism to hold the seat in its upright usable position. When the seat is in its upright usable position, exercise can be continued in a sitting position. If the seat is no longer required, the hinges can be unlocked so that the seat can pivot back toward the lower portion of the handrail to rest against the handrail so that it is out of the way for further stand-up step aerobics.

The improved step aerobic platform is lightweight, easily transportable and storable. The handrail can be easily removed from the slotted ends in the upper surface of the platform to maximize storage and allow for easy handling.

It is an object of the invention to have this combination of a handrail and integral seat on an elevated step aerobic platform to provide support for an individual while stepping onto and off the elevated platform. It is further an object of this invention to provide support for an individual while on the elevated platform. Further, it is an object of this invention to provide a support for times during the exercise period when exercise can be done in a sitting position. Finally, it is an object of this invention to provide an aerobic step platform that functions as a piece of rehabilitation equipment as well as serving as a means for discretionary or recreational exercise, Therefore, this invention provides for a compact step aerobic exerciser that can be used by all exercisers including the elderly and physically challenged individuals.

Other objects, advantages and applications of the present invention will become apparent of those skilled in the art when the following description of the best mode conjunction with the accompanying drawing.

BRIEF DESCRIPTION OF THE DRAWINGS the description herein makes reference to the accompanying drawings wherein like reference numerals refer to like parts throughout the several views, and wherein.

DESCRIPTION OF THE PREFERRED EMBODIMENT

Figure 1:
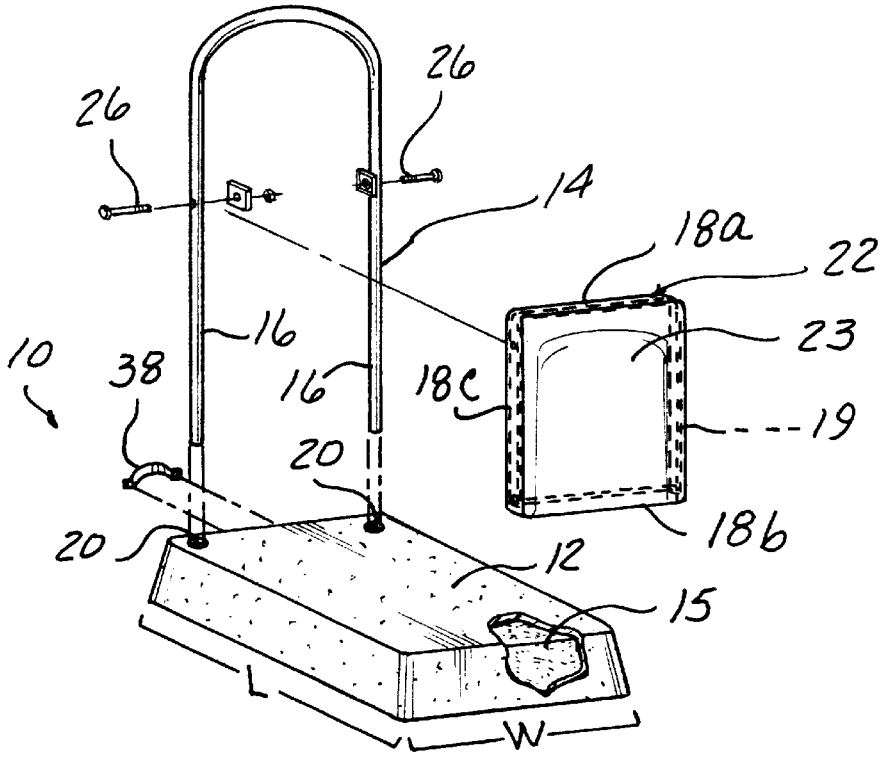
FIG. 1 is an exploded and perspective view of the improved step aerobic platform illustrating handrails and a retractable seat in a retractable position.
Figure 2:
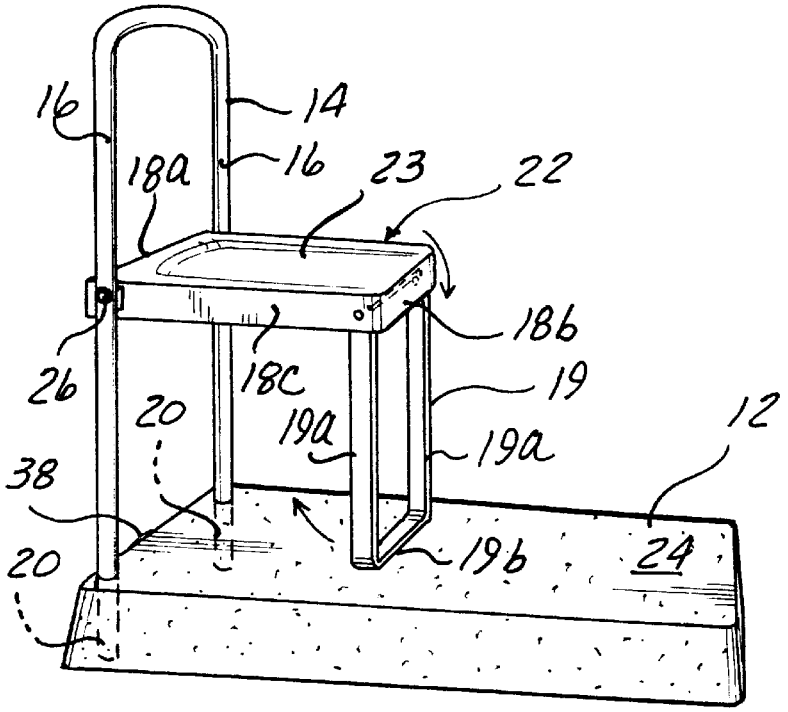
FIG. 2 is a perspective view of the modified step aerobic platform illustrating the seat in an upright usable position.

Referring to FIG. 1 and 2, the improved step aerobic platform 10 is a generally rectangular shaped box, having two opposing sides longer than their adjacent other two sides. For convenience, the longer sides will be referred to as the length (L) and the shorter sides will be referred to as the width (W). A facing surface 12 is the horizontal surface of the platform that defines the area for placement of the feet of a user while utilizing the platform 10.

The facing surface 12 has a plastic outer shell with a dimpled non-skid finish to assure secure footing when the foot is placed on it. the surface 12 is non-porous for easy clean-up with conventional household cleaners. The underside of the platform shell is filled with a foam core 15, preferably polystyrene, to provide a slight "give" during aerobics to lessen the impact of the stepping motion. The underside also has non-skid tabs 17 to prevent the platform 10 from sliding on the floor surface. A laterally spaced tubular U-shaped handrail 14 is selectively secured to the facing surface 12 of the elevated platform proximate to one width (W) of the platform. The handrail 14 includes a pair of side legs 16; and each side leg 16 is positioned at a corner of the platform across the width (W) such that the distance between each side leg 16 is slightly less than (W). Each leg 16 may be selectively secured into individual slotted apertures or channels 20 extending into the platform facing surface 12 essentially through the entire depth of the platform. The slotted apertures 20 are sized to accommodate the legs 16 so that there is no play in the handrail 14 when installed in the platform 10, but yet the handrail is selectively and easily inserted and removed from the apertures 20. the handrail 14 is constructed of high grade aircraft aluminum hollow tubing bent into an arch shape. The tubing has a 1.75 inch outside diameter and a wall thickness of ⅛ inch.

When the seat 22 is in a retracted position, virtually the entire platform facing surface 12 is usable for aerobic steps. In the retracted position, the seat 22 fits between the side legs 16 of the handrail. When the seat 22 is in the usable position, there is an open area 24 forward from the seat front edge 18*a* that can accommodate feet of the user while sitting on the integral seat 22.

The seat portion 22 is, preferably, manufactured from a sheet of vacuum formed plastic. The seat has rounded edges on all side and a slight contour 23 on the "sitting area" for body comfort and safety. For a platform 10 measuring 24 inches by 42 inches by 5.5 inches high, the dimension of the seat portion 22 is ideally 15 inches wide by 18 inches long and having side edges 18*a–c* measuring 2.75 inches around all sides. When the seat portion 22 is in the usable position, the seat portion 22 is in a horizontal position generally 17.5 inches above the facing surface 12 of platform 10. In the horizontal and usable position, the seat 22 allows the participant to engage in additional physical activities, such as weight training and resistance type exercises, as well as those movements as needed in physical therapy sessions.

Figure 3:
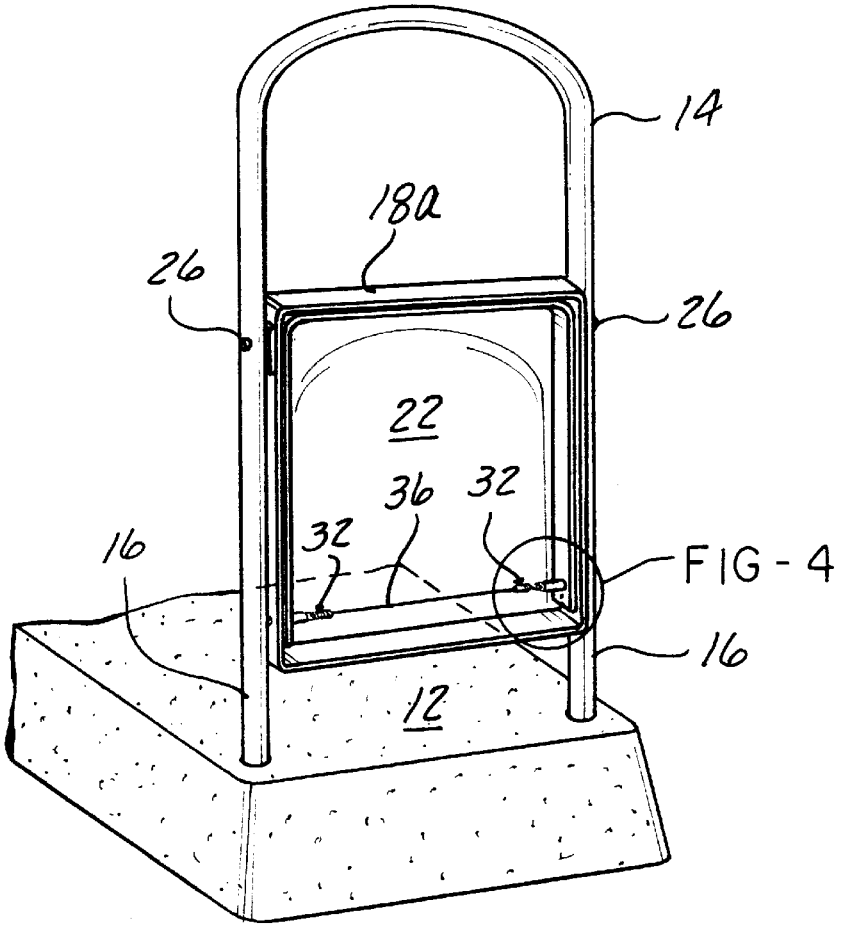
FIG. 3 is a view of the underside of the seat in the retracted position showing a locking mechanism.
Figure 4:
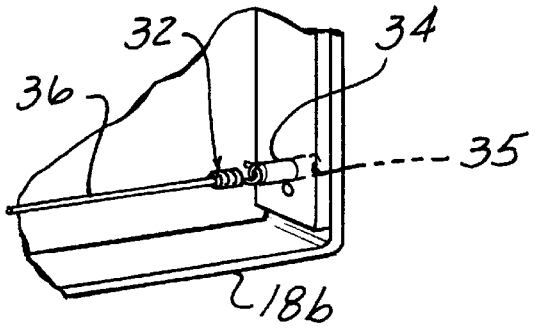
FIG. 4 is the locking mechanism encircled in FIG. 3.

The integral seat 22 is pivotally connected on the vertical legs 16 of the handrail 14. Screws 26 or other vertical legs 16 of the handrail 14. Screws 26 or other means may be used to attach one side end of the seat proximate to the rear edge 18*b* to the vertical legs 16 of the handrails. Pivotally attached near the front edge is the front legs assembly 19. the front legs assembly 19 has a U-shaped configuration such that when the seat 22 and front leg assembly 19 are extending in the usable position, the front legs assembly 19 has two vertical portions 19*a* forming support for the seat 22 and a horizontal portion 19*b* therebetween that rests upon the platform facing surface 12 to provide added support for the seat 22 and to provide a single unit for easier storage of the front legs. By using a U-shaped configuration, the front leg assembly 19 cannot splay or torque out of position, and the downward force on the seat 22 during use is more evenly distributed. The side edges 18*a–c* of the seat hide the U-shaped front legs 19 when the seat 22 is in the retracted position. The side edges 18*a–c* also provide a smooth edge against which the user can placed his legs when sitting on seat 22. As seen in FIG. 3, when the seat portion 22 is folded or retracted in a storage position, the curve side edges 18*a–c* extend over the front leg assembly 19 so that the seat portion 22 sets vertically flush against the vertical legs 16. The front leg assembly 19 is constructed of high grade aircraft aluminum to provide maximum support in a light structure. The material used to construct the front leg assembly 19 is a flat aluminum bar 2 inches by 1.5 inches having rounded edges on all sides for safety.

A bilateral locking pin assembly 32 holds the front leg assembly 19 in the folded and retracted position. The pins 34 provide constant locking pressure and for into matingly locking holes 35 in the sides of the seat 22 proximate to the rear edge. This bilateral locking system greatly reduces the possibility of lock failure since either side of the pin assembly 32 is fully capable of providing positional control of the seat legs 19 individually. The spring loaded locking pins 34 are joined by a cable 35 beneath the edges of seat 22. The cable 36 must be manually engaged to permit movement of the seat legs 19, thus providing a safety feature and helps insure against unexpected leg collapse. The locking pins 34 are screwed into and protrude through the aluminum flat bar of the front leg assembly 19 and lock the legs and seat platform 22 together in whichever of the two positions the user wished. The cable 36 connecting the two spring pins 34 is a vinyl coated steel cable 36 attached to each side of the assembly.

When the seat 22 is locked in an upright usable position, the seat 22 provides a support for an individual to continue doing exercise that can be done in a seated position. The handrails 14 can be used for a back support for exercise while the individual is seated. When the seat 22 is in the retracted position (FIG. 3), and resting against the handrail 14, the step aerobic platform 10 can be used for stepping exercises with the handrails 14 used for support, such as a "ballet bar". Therefore, this invention provides a compact step exercise platform that can be used by elderly as well as the physically disabled or challenged individuals. The addition of this handrail assembly to a step bench provides an area of stability and security not afforded on other step benches. By providing this handrail 14 and integral seat 22 assembly, participants that would not otherwise be able to participate in this type of aerobic activity (senior citizens, those with balance disorders, and those rehabilitating from injury) are able to work out with the security of a solid grasp for their hands. The unit is also very lightweight and can be utilized in home healthcare settings as an aid to physical and occupational therapy. the material used, such as plastic and aircraft aluminum is lightweight, yet very durable and noncorroding. When the improved step aerobic platform is not in use, the handrails 14 can be dismantled from the platform by removing the legs 16 of the handrail 14 from apertures 20. The lightweight construction allows the handrail and platform to be carried to a storage area. To facilitate the transportation of the platform, a strap 38 may be secured at one end of the platform.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An improved aerobic step platform of the type consisting of an elevated essentially rectangular box, the box having an exposed substantially planar upper surface and a substantially flat lower surface adapted to rest on said lower surface wherein the improvement comprises:

a selectively mountable and removable handrail assembly having a single pair of vertical leg portions and a seat portion disposed therebetween, said vertical leg portions releasably attached to and extending within the box below said upper surface, and said seat portion having a surface attached to the vertical leg portions for selectable movement between an upright usable position and a retractable stored position, wherein the vertical leg portions define the back legs of the seat portion and said seat portion has a pivotal front leg asssembly and wherein said seat portions is vertically disposed between the single pair of vertical leg portions when said seat portion is in the retractable stored position.

2. The improved aerobic step platform of claim 1 wherein the pair of vertical leg portions are receivable into correspondingly shaped channels extending into the upper surface of the rectangular box and extending the depth of said box.

3. An improved aerobic step platform of claim 1 wherein the rectangular box has a plastic shell over a foam core, wherein the foam core extends the depth of the rectangular box.

4. The improved aerobic step platform of claim 1 wherein the pivotal front leg assembly has a U-shaped configuration defined by a bottom section disposed between two upright members, said bottom section of the U-shaped configuration resting on the upper surface of the platform when is an upright usable position and wherein said back legs are longer than the upright members.

5. The improved aerobic step platform of claim 1, wherein the seat has a locking mechanism having locking pins joined by a cable beneath the edges of the seat to lock said seat in one of the horizontal usable position and the retracted vertical position.

6. The improved aerobic step platform of claim 1, wherein the handrail and the single pair of vertical leg portions are formed by a single tubular unit.

7. The improved aerobic step platform of claim 6, wherein the seat portion has a front portion and a rear portion, said rear portion pivotally connected to the vertical leg portions and said front portion spaced from said rear portion, wherein the front portion is disposed adjacent the rectangular box when the seat portion is in the retractable stored position.

* * * * *